US005819355A

United States Patent [19]

Wu

[11] Patent Number: 5,819,355

[45] Date of Patent: Oct. 13, 1998

[54] CLUB HEAD BRUSH

[76] Inventor: David Wu, No. 35-1 Joh Hsin Street, Tu Cheng Hsiang, Taipei Hsien, Taiwan

[21] Appl. No.: 44,079

[22] Filed: Mar. 19, 1998

[51] Int. Cl.[6] ..... A47L 13/12

[52] U.S. Cl. ..... 15/106; 15/111; 15/160; 15/236.01; 15/DIG. 6

[58] Field of Search ..... 15/236.01, 106, 15/111, 160, DIG. 6

[56] References Cited

U.S. PATENT DOCUMENTS

| | | | |
|---|---|---|---|
| 1,495,675 | 5/1924 | Colt | 15/111 |
| 2,682,072 | 6/1954 | Green | 15/111 |
| 2,701,378 | 2/1955 | Reinbolt | 15/111 |
| 5,230,117 | 7/1993 | Johnson | 15/106 |

FOREIGN PATENT DOCUMENTS

| | | | |
|---|---|---|---|
| 491030 | 2/1930 | Germany | 15/111 |
| 145984 | 7/1920 | United Kingdom | 15/111 |
| 648340 | 1/1951 | United Kingdom | 15/106 |

*Primary Examiner*—Randall E. Chin
*Attorney, Agent, or Firm*—Varndell Legal Group

[57] ABSTRACT

A club head brush having a first bristle holder and a second bristle holder at one end of the body thereof, the first bristle holder and the second bristle holder holding bundles of bristles of different softness for cleaning golf club heads, and a pick coupled to a sliding switch at an opposite end of the body and used for removing dirt from scoring lines and grooves on golf club heads, the pick being moved in and out of a through hole at the rear end of the club head brush when the sliding switch is moved along a longitudinal sliding slot on the body.

3 Claims, 5 Drawing Sheets

CLUB HEAD BRUSH

BACKGROUND AND SUMMARY OF THE INVENTION

The present invention relates to a club head brushes, and more particularly to such a club head brush which has a retractable pick used for removing dirt from scoring lines and grooves on golf club heads.

A variety of club head brushes have been disclosed, and have appeared on the market. These club head brushes commonly provide soft bristles and firm bristles for different cleaning purposes. However, these bristles cannot effectively remove dirt deposited in scoring lines or grooves on golf club heads.

The present invention provides a club head brush which has means specifically designed for removing dirt from scoring lines and grooves on golf club heads. According to the invention, the club head brush comprises a first bristle holder and a second bristle holder at one end of the body thereof, the first bristle holder and the second bristle holder holding bundles of bristles of different softness for cleaning golf club heads, and a pick coupled to a sliding switch at an opposite end of the body and used for removing dirt from scoring lines and grooves on golf club heads, the pick being moved in and out of a through hole at the rear end of the club head brush when the sliding switch is moved along a longitudinal sliding slot on the body.

DETAILED DESCRIPTION OF THE PREFERRED EMBODIMENT

Figure 1:
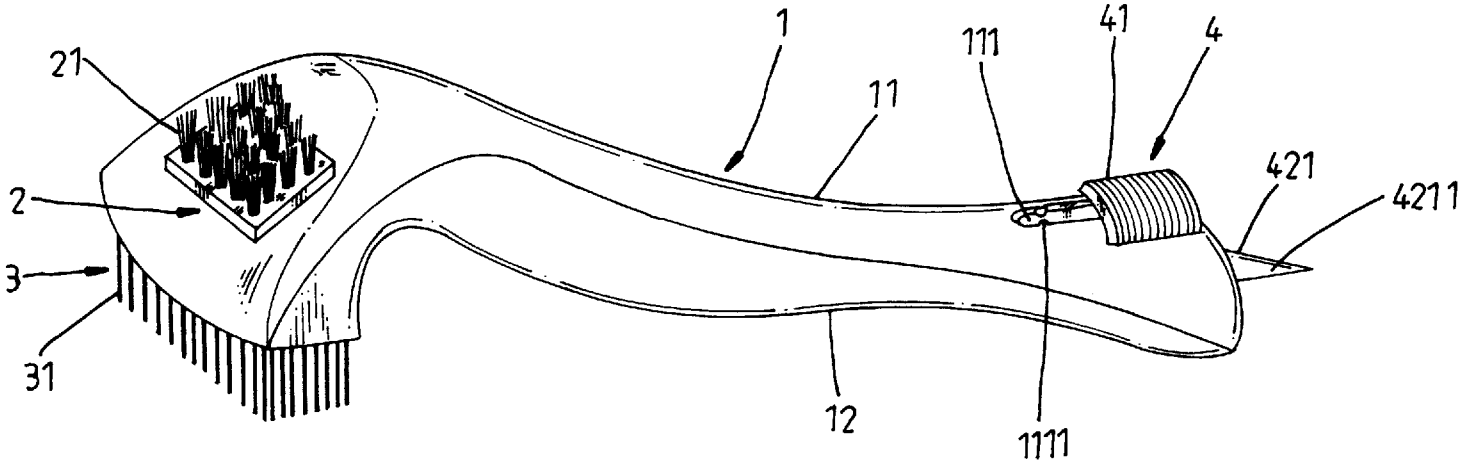
FIG. 1 is a perspective view of a club head brush according to the present invention.

Referring to Figures from 1 to 6, the club head brush 1, comprises a hollow, elongated, curved upper shell 11 and a hollow, elongated, curved bottom shell 12 fixedly fastened together, a first bristle holder 2 fixedly mounted on one end namely the front end of the upper shell 11, and a second bristle holder 3 fixedly mounted on one end namely the front end of the bottom shell 12 opposite to the first bristle holder 2. The first bristle holder 2 holds bundles of soft bristles 21. The second bristle holder 3 holds bundles of metal wires 31.

Figure 3:
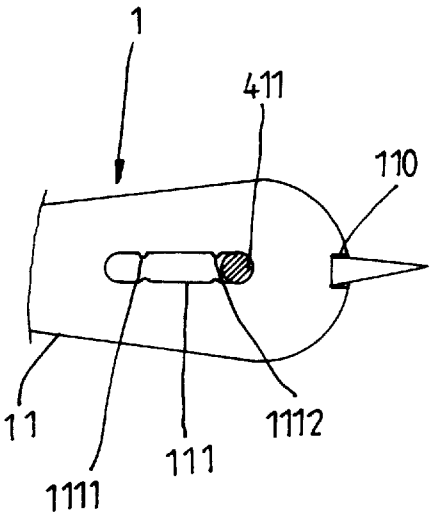
FIG. 3 is a top plan view of a part of FIG. 2, showing the conical tip of the pick extended out of the through hole on the rear end of the upper shell, the downward rod engaged with the second pair of locating projections.
Figure 5:
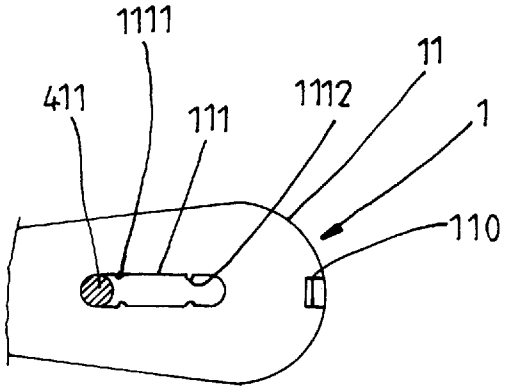
FIG. 5 is a top plan view of a part of FIG. 4, showing the pick retracted, the downward rod engaged with the first pair of locating projections.

Referring to FIGS. 1, 3 and 5, the upper shell 11 comprises a through hole 110 at one end namely the rear end, longitudinal sliding slot 111 adjacent to the through hole 110, a first pair of locating projections 1111 bilaterally projecting into the longitudinal sliding slot 111 near one end remote from the through hole 110, and a second pair of locating projections 1112 bilaterally projecting into the longitudinal sliding slot 111 near one end adjacent to the through hole 110.

Figure 6:
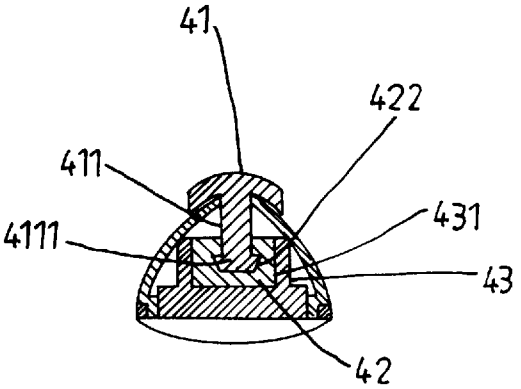
FIG. 6 is a cross-section of the sliding switch at the rear end of the brush.
Figure 2:
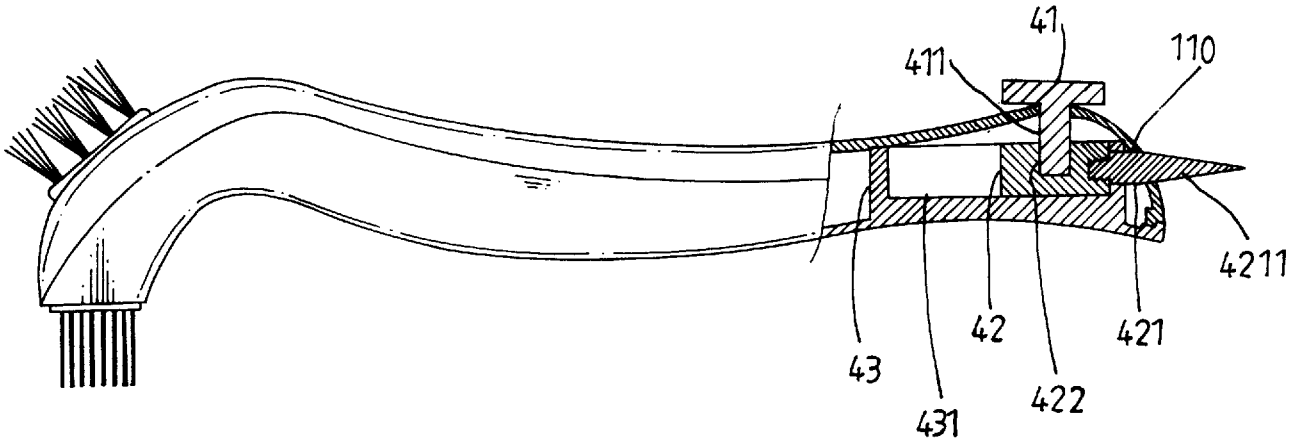
FIG. 2 is a sectional view of the present invention, showing the conical tip of the pick extended out of the through hole on the rear end of the upper shell.
Figure 4:
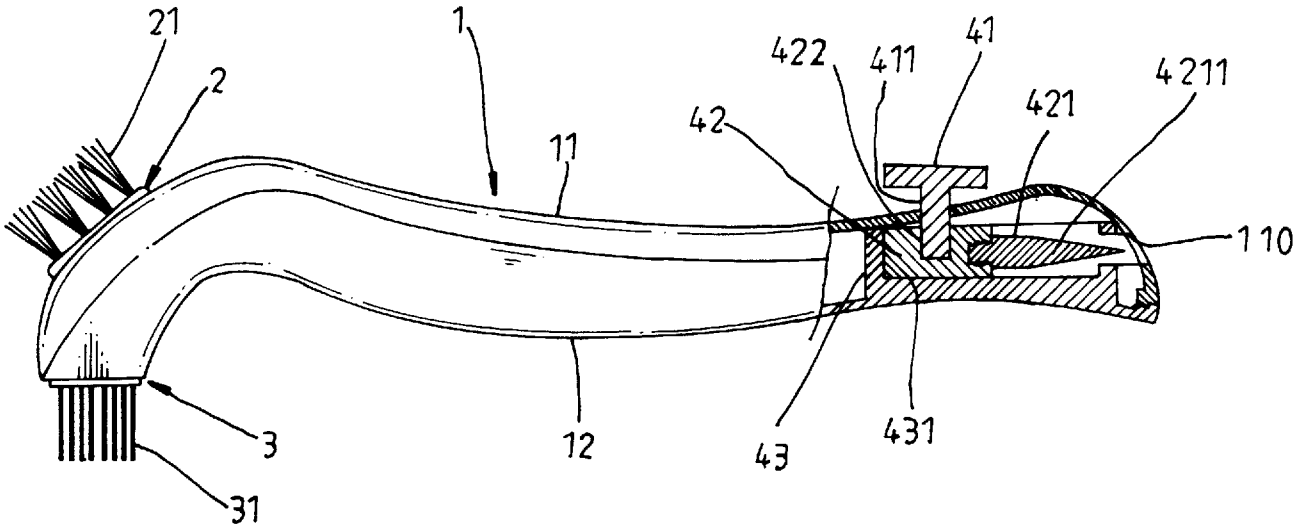
FIG. 4 is another sectional view of the present invention, showing the pick received in the casing inside the bottom shell.

Referring to FIGS. 2, 4 and 6, a casing 43 is integral with the bottom shell 12 on the inside corresponding to the longitudinal sliding slot 111 on the upper shell 11. The casing 43 defines a longitudinal sliding chamber 431 in line with the through hole 110 on the rear end of the upper shell 11. A sliding switch 4 is mounted in the longitudinal sliding slot 111 on the upper shell 11 and driven to move a pick 421 in and out of the through hole 110. The sliding switch 4 comprises a knob 41 having a downward rod 411 inserted through the longitudinal sliding slot 111 on the upper shell 11, and a sliding block 42 coupled to the downward rod 411 of the knob 41 and moved with the downward rod 411 in the longitudinal sliding chamber 431 within the casing 43. The pick 421 is fixedly fastened to one side of the sliding block 42. The pick 421 has a conical tip 4211 for removing dirt from the scoring lines or grooves on the outside wall of the golf club head. Further, the rod 411 of the knob 41 has a coupling flange 4111 at the end, which is forced into engagement with a coupling hole 422 on the sliding block 42 (see FIG. 6).

When in use, the sliding switch 4 is moved with the hand in one direction along the longitudinal sliding slot 111 to extend the conical tip 4211 of the pick 421 out of the through hole 110 on the rear end of the upper shell 11 (see FIGS. 1 and 2). When not in use, the sliding switch 4 is moved with the hand in the reversed direction along the longitudinal sliding slot 111 to retract the pick 421, enabling the pick 421 to be completely received inside the casing 43 (see FIG. 4). When sliding the sliding switch 4, the downward rod 411 of the knob 41 is forced to pass through the first pair of locating projections 1111 and the second pair of locating projections 1112. When the downward rod 411 is moved with the knob 41 to one end of the longitudinal sliding slot 111 to move the conical tip 4211 of the pick 421 out of the through hole 110 on the upper shell 11, the downward rod 411 is retained in position by the second pair of locating projections 1112, and therefore the pick 421 is maintained in the extended position (see FIGS. 2 and 3). When the downward rod 411 is moved with the knob 41 to the other end of the longitudinal sliding slot 111 to retract the pick 421, the downward rod 411 is retained in position by the first pair of locating projections 1111, and therefore the pick 421 is maintained received inside the casing 43. By applying a push force or pulling force to the knob 41, the downward rod 411 is moved out of the constraint of the locating projections 1111 or 1112.

I claim:

1. A club head brush comprising a hollow, elongated, curved body having a front end and a rear end, a first bristle holder holding bundles of soft bristles and a second bristle holder holding bundles of metal wires, respectively, mounted on top and bottom sides of the front end of said body, wherein said body comprises a through hole at the rear end, a longitudinal sliding slot at a top side thereof adjacent to said through hole, a first pair of locating projections at two opposite sides of said longitudinal sliding slot remote from said through hole, and a second pair of locating projections at two opposite sides of said longitudinal sliding slot adjacent to said through hole; a sliding switch is mounted in said longitudinal sliding slot and moved between two ends of said longitudinal sliding slot, said sliding switch comprising a knob disposed outside said body and moved along said longitudinal sliding slot between a first position and a second position, said knob having a downward rod inserted through said longitudinal sliding slot, said downward rod being forced into engagement with said first pair of locating projections when said knob is moved to said first position, said downward rod being forced into engagement with said second pair of locating projections when said knob is moved to said second position, and a sliding block coupled to the downward rod of said knob, a pick is mounted on said sliding block and moved with said sliding switch in and out of said through hole, said pick having a conical tip for removing dirt from scoring lines on golf club heads, said pick being extended out of said through hole when said knob is moved to said second position, said pick being received inside said body when said knob is moved to said first position.

2. The club head brush of claim 1, wherein said sliding block has a coupling hole at a top side thereof; the downward rod of said knob has a coupling flange engaged in the coupling hole on said sliding block.

3. The club head brush of claim 1, wherein a casing is integral with said body on the inside, said casing defining a longitudinal sliding chamber in line with said through hole in which said sliding block is moved.

* * * * *